US007768428B1

(12) United States Patent
Leisure

(10) Patent No.: US 7,768,428 B1
(45) Date of Patent: Aug. 3, 2010

(54) SAFETY WARNING DEVICE USING A VISUAL TAPE WITH AN OPTIONAL LASER COMPONENT

(76) Inventor: Rodney Lynn Leisure, 2251 Nettleton La., Broadview Hts, OH (US) 44147

( * ) Notice: Subject to any disclaimer, the term of this patent is extended or adjusted under 35 U.S.C. 154(b) by 450 days.

(21) Appl. No.: 11/906,221

(22) Filed: Oct. 1, 2007

Related U.S. Application Data

(60) Provisional application No. 60/849,144, filed on Oct. 3, 2006.

(51) Int. Cl.
*G08G 1/04* (2006.01)

(52) U.S. Cl. ..... 340/942; 340/908.1; 296/43

(58) Field of Classification Search ..... 340/901, 340/903, 907, 908, 908.1, 942; 296/43; 256/1
See application file for complete search history.

(56) References Cited

U.S. PATENT DOCUMENTS

| | | | |
|---|---|---|---|
| 1,280,670 | A | 10/1918 | Cornell |
| 1,548,518 | A | 3/1925 | Edlich |
| 1,845,092 | A | 4/1930 | Meininghaus |
| 2,388,304 | A | 10/1944 | Ackerman |
| 3,940,179 | A | 2/1976 | McBride |
| 4,077,331 | A | 3/1978 | Val Verde |
| 4,533,122 | A | 8/1985 | Bannister |
| 5,050,846 | A | 9/1991 | Goodman et al. |
| 5,280,622 | A | 1/1994 | Tino |
| 5,320,396 | A | 6/1994 | Petelka |
| 5,501,429 | A | 3/1996 | Sakuma |
| 5,710,553 | A | 1/1998 | Soares |
| 5,940,012 | A | 8/1999 | Studebaker |
| 6,375,164 | B1 | 4/2002 | Siegler et al. |
| 6,682,055 | B1 | 1/2004 | Tomlinson |
| 6,776,398 | B1 | 8/2004 | Tsai |
| 6,857,677 | B1 | 2/2005 | Giles et al. |
| 6,917,854 | B2 | 7/2005 | Bayer |
| 6,969,050 | B1 | 11/2005 | Loebner |
| 7,538,688 | B1 * | 5/2009 | Stewart ..... 340/908 |

* cited by examiner

*Primary Examiner*—Jeffrey Hofsass

(57) ABSTRACT

A Safety Warning Device which when the visual tape and laser mechanisms are components of vertical posts (both primary and corresponding), can be mounted to a base (permanent or portable) or customized to fit on a flatbed trailer, which when the visual tape is extended and the laser mechanism is activated provides both an audible and visual warning, notifying person(s) when they are in danger or in a restricted/unauthorized area. The tape is a visual warning which is high enough to be seen by person(s). The height can be adjusted on both the primary and corresponding posts. The laser is both a visual warning (as the light/laser beam is visible) and an audible warning when the laser connection is disturbed or interrupted. This can be an immediate warning as well as a signal sent to an alternative warning mechanism.

20 Claims, 7 Drawing Sheets

Installed Side View

Installed Rear Side View

Installed Overhead View

Safety Warning Device
Side-View Primary Post

Safety Warning Device
Side-View Corresponding Post

Safety Warning Device
Front View-Primary Post

Safety Warning Device
Mounted Post with Alternative
warning Mechanism

SAFETY WARNING DEVICE USING A VISUAL TAPE WITH AN OPTIONAL LASER COMPONENT

CROSS-REFERENCE TO RELATED APPLICATIONS

This application claims the benefits of PPA 60/849,144 filed Oct. 3, 2006 by Rodney Leisure.

BACKGROUND

Shipping personnel have refused to work on the bed of regular flatbed trailers or drive forklifts (i.e. loading/unloading devices) on regular flatbed trailers due to the fear of falling over the edge or end of this type of trailer.

Some flatbed trailers are equipped with removable walls or "side kits". These are specialized trailers and are not common place when contracting flatbed services.

These side kits are owned by the trucking company and considered part of the trailer. Typically they are bulky, heavy and not easily assembled or removed. Their primary use is protection of the cargo during transit. Other then the walled site line of side kits, they provide limited visual and no audible warning to the cargo loader of his proximity to the edge or end of the trailer. A mechanism does not exist that provides both a visual site line and an audible warning of danger when loading flatbed trailers.

Because there are differences in the style of regular flatbed trailers. A need also exists for a safety warning device to be convertible, able to conform to the different flatbed trailer types and used universally.

An audible and visual safety warning device would benefit both the trucking company and the shipping or receiving company. Making this safety warning device storable will enable it to be owned and transported by the truck operator and/or shipping personnel at the site of loading or unloading.

Many times cargo loading areas are staffed with only a few employees or direct supervision is lacking during the loading or unloading process. A need exists to audibly alert both the employee loading cargo onto or off a trailer, any personnel near this impending danger and any off site personnel who can assist or prevent injury when notified.

These safety concerns also apply in areas other then the loading or unloading of cargo on regular flatbed trailers. As an example construction areas and machine shops have also looked for ways to warn employees or visitors of danger.

A similar need is seen in alerting personnel or warning individuals of impending danger with both audible and visual means. Currently there is not a portable device that provides a person or persons a warning of danger both visually and audibly, which can be configured to the specific area being protected.

Based on the problems set forth above a need exists for both a visual warning and audible warning signal, with the ability to easily install, remove and store this device and for the ability to notify off site personnel of another persons danger or intrusion.

This device should be portable, storable, and able to convert, allowing proper set-up. It can be customized for use with flatbed trailers or mounted to a stand and used as a general purpose safety warning device. Which may be portable, or permanently secured to provide a stationary warning device.

SUMMARY

A Safety Warning Device promoting safe loading/unloading of regular flatbed trailers, using both a visual and audible warning mechanism and is removable, convertible and easily stored. The safety device includes posts which rest on the floor of a regular flatbed trailer and lock into the side railing to stabilize and hold the post in place with the use of an adjustable tension pad. Visual tape that provides a site line for loading personnel to view where the end or edge of the trailer is, even while on a forklift or loading machine. A laser mechanism with circuitry connected between two posts provides a visual site line and an audible alert when the laser beam is interrupted or disturbed. The alert gives an immediate warning that the loading instrument or person is dangerously close to the edge of the trailer. An additional alternative warning mechanism can be used to alert off site personnel when the laser beam is interrupted.

One aspect of this invention is to provide an easy and temporary means to safely load regular flatbed trailers, which do not already have side kits or other permanent/semi-permanent sidings. This safety device is meant to be removed and used on different styles of regular flatbed trailers as it is convertible. It can be provided by the shipper, receiver or transportation company, as it is easily storable.

This safety warning device, designed for use on a regular flatbed trailer can provide two means of warnings to loading/unload personnel:

1. A visible tape or strip extended from the top of the device extends from the end of a trailer to the front or opposite end of the trailer (positioned at the furthest front and rear of trailer). The height can be adjusted to allow visibility by a person on a forklift, allowing a clear site line identifying the edge of the trailer.

2. A laser mechanism whose laser beam completes a circuit between the primary and corresponding posts. If a worker or loading/unloading machinery approaches the edge of the trailer, interrupting the laser beam (extending from one post to the other) an audible warning signal will sound. This immediately alerts the worker to redirect his person or device preventing him from falling over the edge of a trailer.

The laser beam can also provide a notification to personnel not located at the loading location by means of a separate alternative warning mechanism giving a visual and/or audible warning that the laser beam has been disturbed or interrupted. This gives a warning that assistance is needed or that further supervision is required.

The device can be removed, allowing the trailer to proceed to its destination. This device can then be used at the delivery point in the same manner (if provided by the trucking company or also owned by the receiving company). If owned by the shipping location it can be used for loading the next regular flatbed trailer.

A Safety Warning Device using straight vertical posts, when mounted in a base or platform will provide immediate warning to someone or something of danger or of an unauthorized area. The safety device includes, visual tape that provides a site line, a laser mechanism with a laser beam (laser circuitry) connected between two posts providing a visual site line and an audible alert when the laser beam is interrupted or disturbed. The alert gives an immediate warning that an instrument or person is dangerously close to an unauthorized area. An additional alternative warning mechanism can be used to alert off site personnel when the laser beam is interrupted.

The visual tape or strip provides a site line alerting someone of a dangerous or unauthorized area.

The laser beam has the appearance of a site line, but the true benefit is as an audible warning produced when the laser beam is interrupted, immediately alerting the person of potential danger. This warning can also be transmitted to an alternative warning mechanism, alerting personnel (by sound and/or warning light) not in the immediate area when this laser beam is interrupted.

Still further benefits will become apparent from a study of the following description and accompanied drawings.

DRAWINGS

DETAILED DESCRIPTION

The safety warning device includes the following primary components: Primary Post (11) to house the unit, Extending Leg (12) to allow holding the unit in the trailer railing or pocket, Pad (13) and Adjustable Mechanism for the Pad (14) to secure the post firmly on the trailer, Corresponding Post (16) which serves as the circuit connector for the laser beam and secures the visual tape, Extended Arm (31) to house the laser mechanism and circuitry connector, Laser Source (Mechanism) (32) which is the source of the laser beam warning device, Laser Receiver (Circuitry Connector) (33) completing the laser beam circuitry, Tape Housing (51) holding the visual tape in the primary post, Extendable Visual Tape (52) serves as a visual guide extending from the primary post to the corresponding post, Connector Hook (53) used to secure the tape to the Connector Housing (54) which is contained in the Corresponding Post, Alternative Warning Mechanism (61) which notifies a person not in the immediate area if the laser beam is interrupted by a Visual Light (62) and/or Audible Alert Mechanism (63), Primary Vertical Post (71) which can house the visual tape and laser device components, Corresponding Vertical Post (73) which serves as the circuit connector for the laser beam and secures the visual tape, Mounting Base (72) used to hold the vertical post for applications other then on a flatbed trailer, a Height Adjusting Mechanism (81) option on all posts, with a Locking Pin (83) inserted into the Locking Pin Hole (82) holding it in place.

Figure 1:
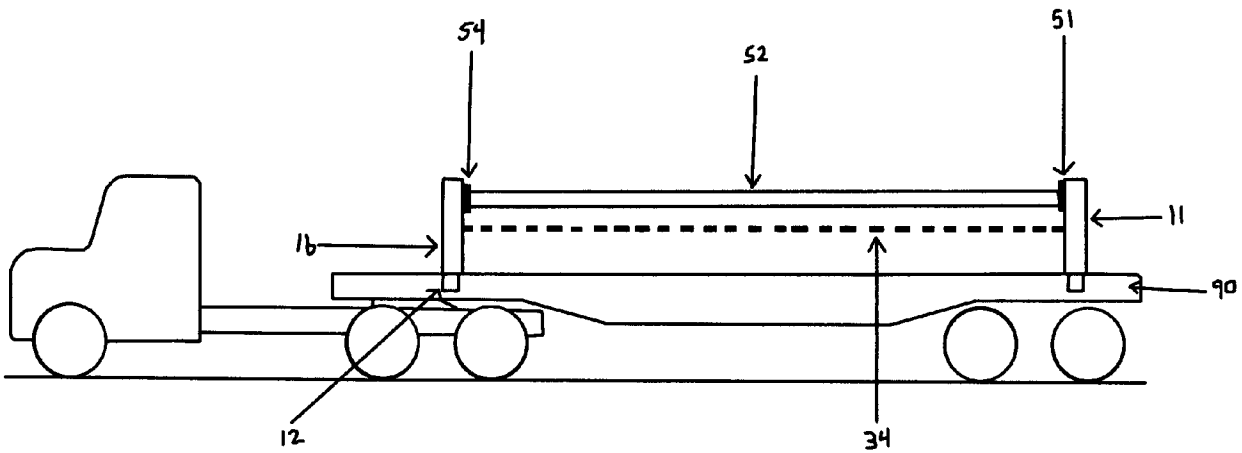
FIG. 1 is a panoramic side view of a regular flatbed trailer with the Safety Warning Device, both primary and corresponding posts, installed and fully operational in accordance with aspects of the present invention.

FIG. 1 illustrates a safety warning device in accordance with the present A perspective (panoramic) view of the product in use is shown. The primary post (11) and corresponding post (16) are resting on the trailer (90) and resting in the side railing (91) or trailer pockets (92). The extending leg (12) is seen, however the pad (13) and adjustable mechanism for the pad (14), which secure the post, are not visible from this long range depiction. The visual tape (52) is shown extended and hooked to the corresponding post (16), there is limited views of the tape housing (51) and the connector housing (54). The connector hook (53) is not viewable because it is engaged in the connector housing. The laser beam (34) is activated and visible, from this view the extended arm (31) and the laser source mechanism (32) (on the primary post), or laser receiver (circuitry connector) (33) (on the corresponding post), cannot be seen. Also not shown is the alternative warning mechanism (61).

Figure 2:
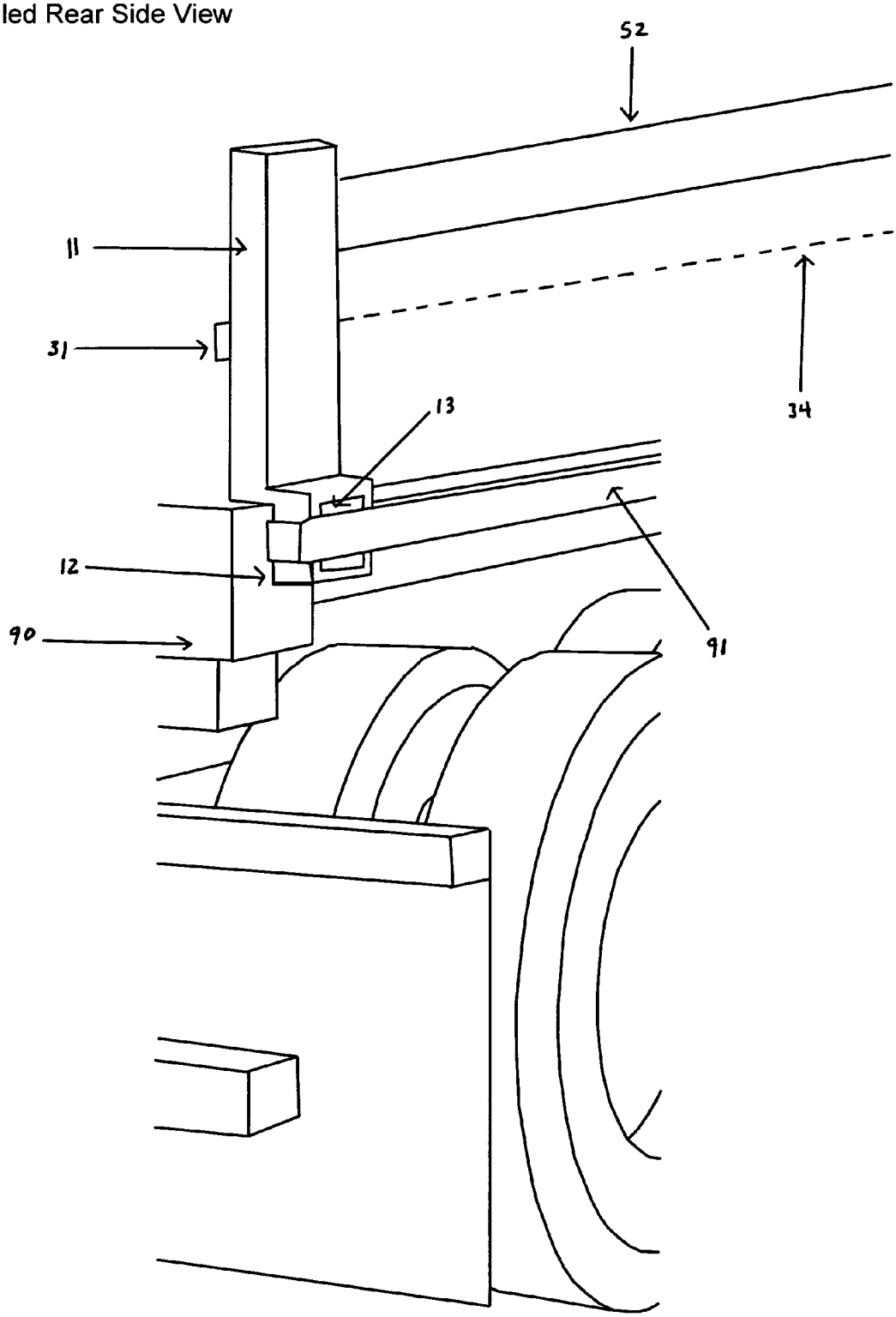
FIG. 2 is a perspective view of a Safety Warning Device (primary post) installed and operational, on the right rear side of a regular flatbed trailer in accordance with aspects of the present invention.

FIG. 2 illustrates a safety warning device in accordance with the present. The safety warning device is secured to an extending leg (12) resting in a side rail (91) of the trailer (90) secured by the extending leg (12) resting in the side railing (91) of the trailer. The pad (13) on the extending leg removes any slack or looseness as the device needs to be unmoving. The post (11) is setting upright, also resting flat on the trailer floor. The extended arm (31) of the laser mechanism is visible as is the laser beam (34) when activated, not visible is the laser source mechanism (32) contained in the extended arm. The extendable visual tape (52) is shown in use, this hooks to the corresponding post (not shown), also not visible from this angle is the tape housing (51) and the connector hook (53) attached at the end of the visual tape. Also not shown is the alternative warning mechanism (61).

Figure 3:
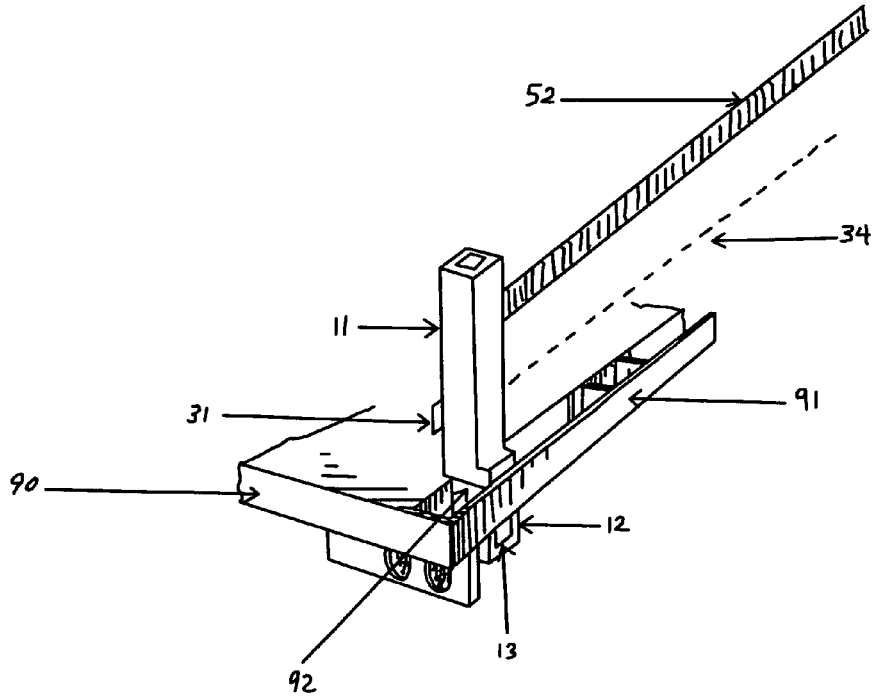
FIG. 3 is an overhead view of the Safety Warning Device (primary post) installed and operational, on the right rear side of a regular flatbed trailer in accordance with aspects of the present invention.

FIG. 3 illustrates a safety warning device in accordance with the present. The primary post (11) resting on the trailer (90) with the extending leg (12) nested in the trailer pocket (92) and side railing (91), being held secure by the pad (13) and adjustable mechanism for the pad (14) (which is not visible). The laser is activated and the laser beam (34) is visible, as well as the extended arm (31) of the laser source mechanism (32), this laser beam extends to the corresponding post (16) which houses the laser receiver (circuitry connector) (33), both of which are not viewable in this figure. The extendable visual tape (52) is shown, however neither the tape housing (51) nor the connector hook (53) is seen from this angle. Also not shown is the alternative warning mechanism (61).

Figure 4:
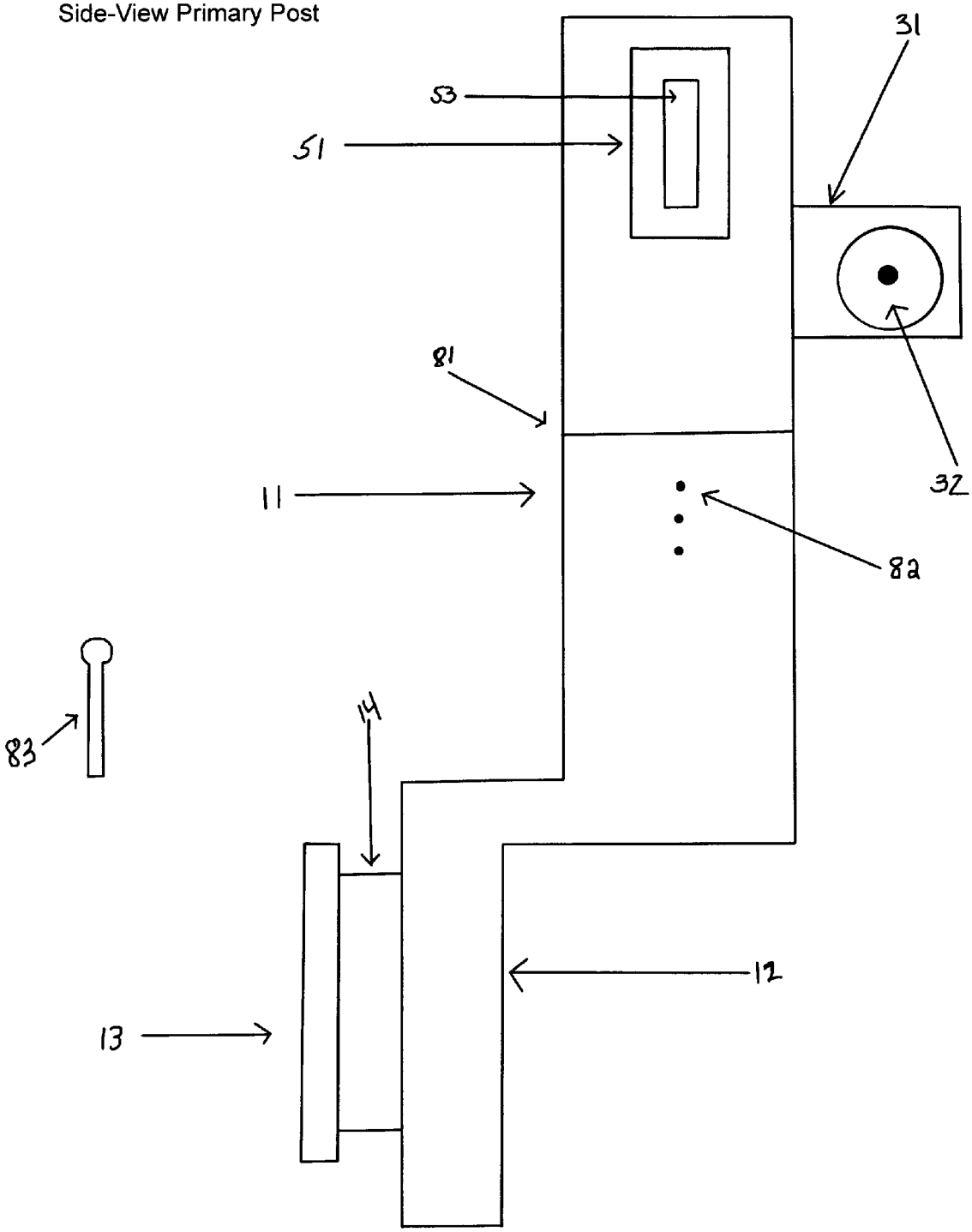
FIG. 4 is the side view (facing) of the Safety Warning Device (primary post) in accordance with aspects of the present invention.

FIG. 4 illustrates a safety warning device in accordance with the present. A side view of the primary post (11), not engaged nor on a trailer. The extending leg (12) is shown from the side with the adjustable mechanism for the pad (14) and pad (13) fully visible. The extendable visual tape (52) is retracted in the tape housing (51) and not seen. The connector hook (53) is shown as it is attached to the end of the extendable visual tape. The extended arm (31) of the laser is seen attached to the side of the post, which includes the laser source mechanism (32) which when activated beams the laser light (34) to the laser receiver (circuitry connector) on the corresponding post (both not shown on this figure). Also not shown is the alternative warning mechanism (61). An optional height adjustment can be included in the posts shown as a height adjustment mechanism (81), a locking pin (83) which fits into a locking pin hole (82).

Figure 5:
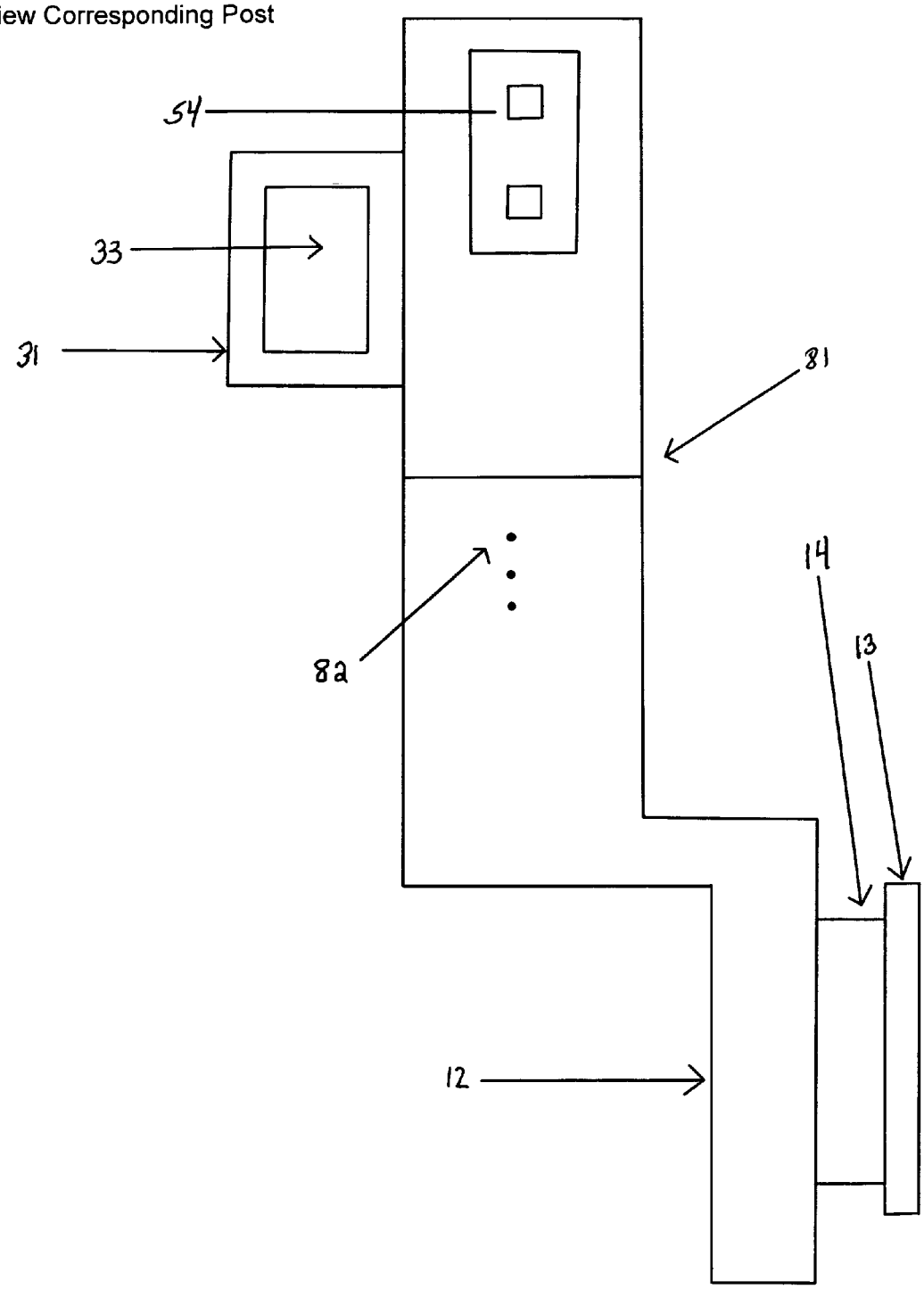
FIG. 5 is the side view (facing) of the Safety Warning Device (corresponding post) in accordance with aspects of the present invention.

FIG. 5 illustrates a safety warning device in accordance with the present. A side view of the corresponding post (16) not engaged nor on a trailer. The extending leg (12) is shown from the side with the adjustable mechanism for the pad (14) and pad (13) fully visible. The extendable visual tape is not engaged, so the tape (51) and connector hook (53) is not seen. The connector hook would be secured in the connector housing (54) to lock into place, supporting the visual tape the length of the extension. The extended arm (31) of the laser is seen attached to the side of the post, which includes the laser receiver (circuitry connector) (33) when the laser is activated this serves as the receiving point to complete the laser circuit. Also not shown is the alternative warning mechanism (61). An optional height adjustment can be included in the posts shown as a height adjustment mechanism (81), a locking pin (not shown) which fits into a locking pin hole (82).

Figure 6:
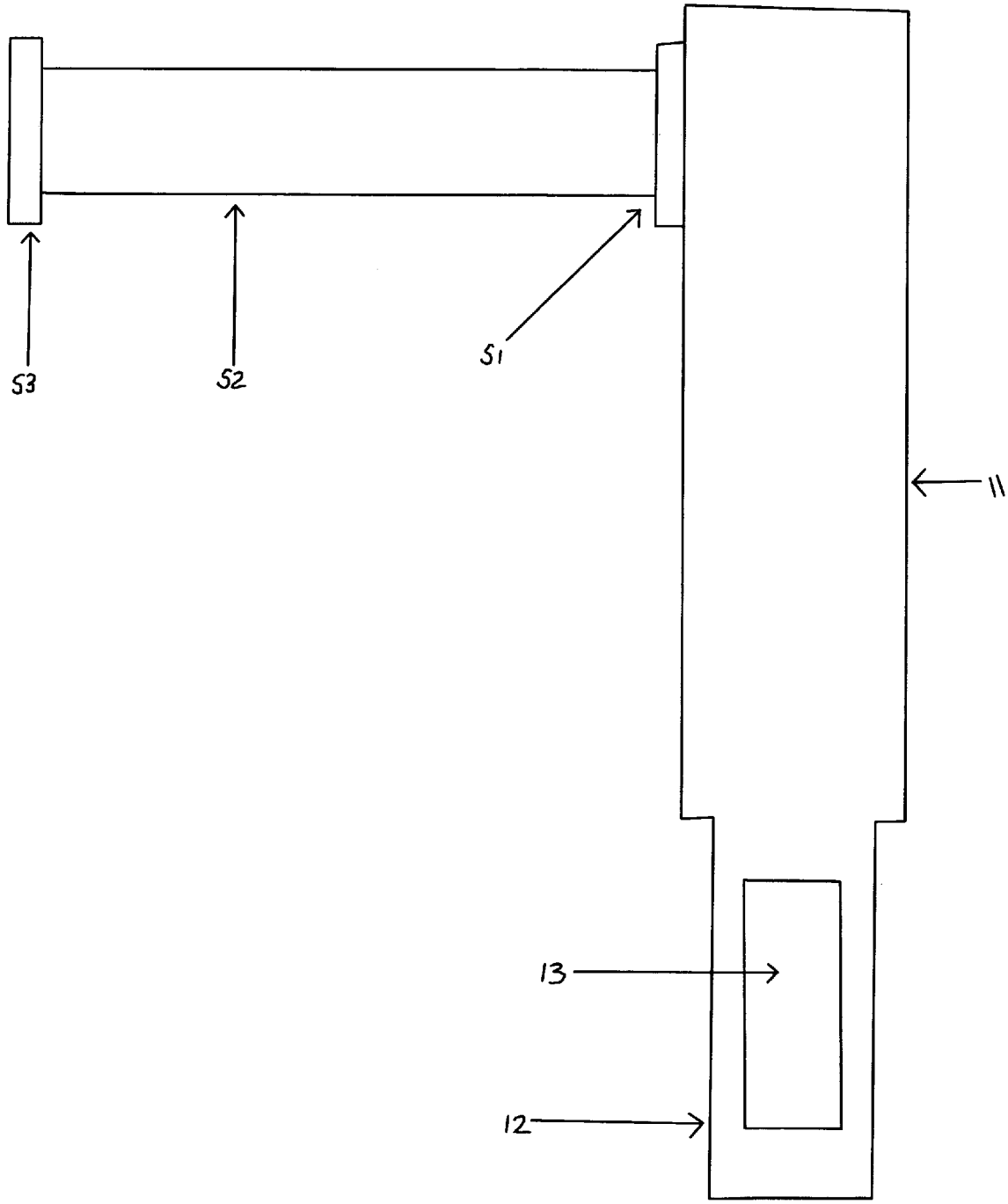
FIG. 6 is the front view of the Safety Warning Device in accordance with aspects of the present invention (primary post).

FIG. 6 illustrates a safety warning device in accordance with the present. A front view of the primary post (11), not fully engaged nor on a trailer, with the extended visual tape (52) extracted showing the connector hook (53) which is attached to the end of the visual tape. The tape housing (51) is viewable, which retracts or releases the tape. The extending leg (12) is shown with the pad (13) facing. Not in this view is the adjustable mechanism for the pad (14), hidden behind the pad. Also not seen is the extended arm (31), which houses the laser mechanism. The laser is not activated in this figure. Also not shown is the alternative warning mechanism (61).

Figure 7:
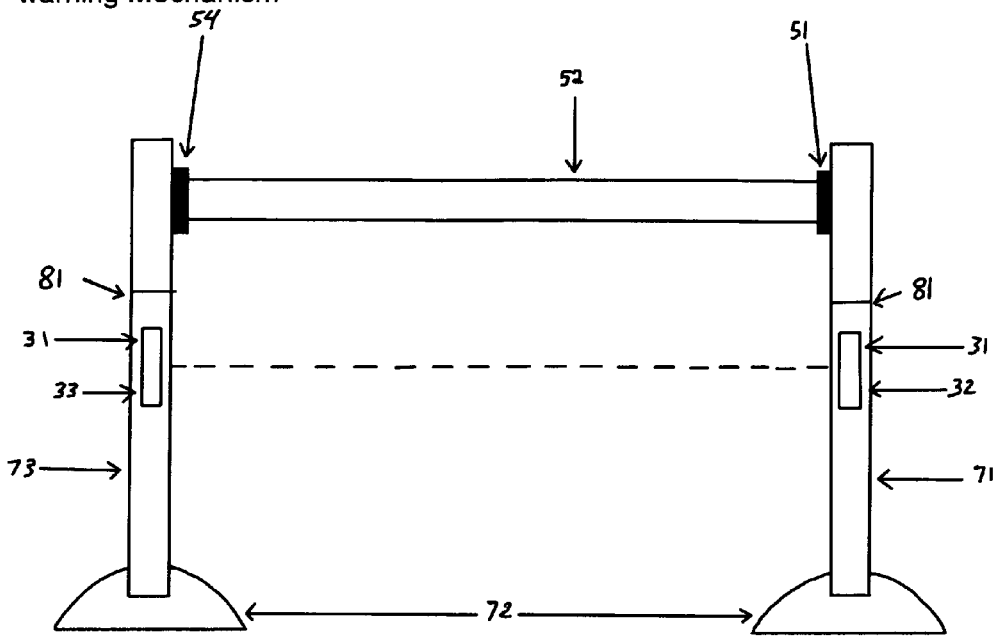
FIG. 7 is a view of an alternative use of the Safety Warning Device using straight vertical posts mounted on a base or stand. Also shown is the alternative warning mechanism located not in the immediate area of the safety warning device.
Figure 7:
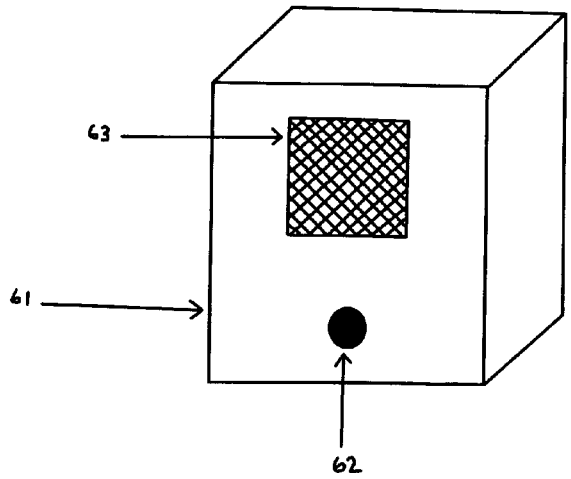

FIG. 7 illustrates an alternative mode of a safety warning device in accordance with the present. A side view of the primary vertical post (71) and corresponding vertical post (73) installed in the mounting base (72) and fully engaged. The visual tape (52) is shown extended and hooked to the corresponding vertical post (16), there is limited views of the tape housing (51) and the connector housing (54). The connector hook (53) is not viewable because it is engaged in the connector housing. The laser beam (34) is activated and visible, from this view the extended arm (31) and the laser source mechanism (32) (on the primary post), or laser receiver (circuitry connector) (33) (on the corresponding vertical post), cannot be seen. Also shown is an example of the alternative warning mechanism (61) which can warn off site personnel when the laser beam is disturbed or interrupted. This warning can be visual from the visual light (62) or audibly from the audible alert mechanism (63). An optional height adjustment can be included in the posts shown as a height adjustment mechanism (81).

OPERATION

A Safety Warning Device, which when in operation, a person places a primary (11) and corresponding post (16) on each side of a regular flatbed trailer. These posts are removable, convertible and storable. The posts are held in place by placing the extending leg (12) in either the trailer side railing (91) or the trailer pocket (92). The post is further secured with the adjustable pad mechanism (14) and the pad (13) which supplies tension pushing against the trailer rail.

An alternative mode of a Safety Warning Device whose visual and audible alerts are incorporated (extendable visual tape and laser device) in a straight, primary vertical (71) and corresponding vertical (73) post. These posts are held in place by a permanent base (72) and can be permanently secured or moveable (transportable).

The extendable visual tape (52) is pulled from the tape housing (51) which is contained in the primary post (or primary vertical post). The tape is extended and hooked to the connector housing (54) with the connector hook (53). The connector hook is attached to the extendable tape, the connector housing is contained in the corresponding post (or corresponding vertical post).

The laser device is extended further away from the post by the extended arm (31) which houses the laser source mechanism (32) in the primary post (or primary vertical post) and the laser receiver (circuitry connector) (33) in the corresponding post (or corresponding vertical post). When activated a laser beam (34) is visible, extending from the laser source mechanism in the primary post to the laser receiver circuitry connector in the corresponding post The laser device can also alert an alternative warning mechanism (61) which is used to notify off site personnel.

When fully activated this Safety Warning Device alerts personnel (who may or may not be on loading machinery) by:

1. The extendable visual tape provides a visible warning of where the edge of the trailer is, or that the area is not authorized. The height of this tape makes it viewable to a person standing as well as someone using loading/unloading machinery (example: forklift).

2. The laser device provides a secondary visible warning with the laser beam that extends from the primary to corresponding post activating a warning signal (audible and or visible). When this connection is interrupted or disturbed a warning signal is sounded immediately warning that the edge of the trailer is near or that a person and/or object is in an unauthorized area. In addition a signal can be sent to the alternative warning mechanism notifying personnel not in the immediate area.

3. A Safety Warning Device using both the visual tape and the laser device in conjunction, provides an unique advantage. The extendable visual tape provides a clear visual warning and the laser device when activated provides a visual warning from the light of the laser beam as well as an audible signal when this laser beam is interrupted. This can be an immediate warning as well as a signal sent to the alternative warning mechanism notifying personnel not in the immediate area.

4. A Safety Warning Device with an alternative warning mechanism, which alerts off site personnel when the laser beam is disturbed or interrupted. This allows for people not in the immediate area to provide assistance, aid or increased supervision when notified of this breach of security.

The invention claimed is:

1. A safety warning device comprising a primary and corresponding post formed to rest on the bed of a flatbed trailer; said posts include an adjustable pad, which is a means for securing the post to the trailer a visual tape able to be secured between the primary and corresponding post a laser source secured to the primary post, wherein the laser source emits a focused laser beam thereby, completes the laser circuitry between the laser source and a receiver secured to the corresponding post.

2. The safety warning device of claim 1 wherein the visual tape is a means for visual warning to the proximity of the trailer edge.

3. The safety warning device of claim 1 further including an audible indication when an associated object interrupts said laser beam emitted by the laser source and received by the laser receiver.

4. The safety warning device of claim 3 further including an alternative warning mechanism, wherein when the laser beam is interrupted an electronic signal is sent to said alternative warning mechanism producing an audible, visual, or both audible and visual warning.

5. The safety warning device of claim 1 further including a means for adjusting the height of said primary and corresponding posts.

6. The safety warning device of claim 1 further including said primary and corresponding posts wherein the posts are portable and storable.

7. A safety warning device comprising a primary and corresponding post created specifically for use with a flatbed trailer, whose narrow design does not restrict the transit of a forklift or loading device while on the flatbed trailer, uniquely formed specifically to the dimensions of a flatbed trailer, resting flatly on the bed of said trailer, said posts include a horizontally adjustable pad, which fits into the side railing of a flatbed trailer by an offset extending leg, adjustable to conform to any variance of flatbed railing, able to tightly secure the Safety Warning Device to the specific design of a flatbed trailer, a visual tape able to be secured between the primary and corresponding post, located on the top portion of the primary and corresponding posts, allowing the tape to be visual from the seat of a forklift of loading device.

8. The safety warning device of claim 7 wherein the visual tape is a means for visual warning to the proximity of a trailer edge.

9. the safety warning device of claim 7 further including a means for adjusting the height of said primary and corresponding posts to allow for alterations of height making the tape visual from a forklift of loading device.

10. The safety warning device of claim 7 further including said primary and corresponding posts wherein the posts are portable and storable.

11. A safety warning device comprising a primary and corresponding vertical post mounted to a base, whose base is not permanently secured to flooring or a platform allowing for portability a visual tape able to be secured between the primary and corresponding post a laser source secured to the primary post, wherein the laser source emits a focused laser beam a laser receiver for said laser source, secured to the corresponding post, which receives the laser beam thereby, completes the laser circuitry.

12. The safety warning device of claim 11 wherein the visual tape is a means for visual warning a person of impending danger.

13. The safety warning device of claim 11 further including an audible indication when an associated object interrupts said laser beam emitted by the laser source and received by the laser receiver.

14. The safety warning device of claim 13 further including an alternative warning mechanism, wherein when the laser beam is interrupted an electronic signal is sent to said alternative warning mechanism producing an audible, visual or both audible and visual warning.

15. The safety warning device of claim 11 further including a means for adjusting the height of said primary and corresponding posts.

16. The safety warning device of claim 11 wherein said base is permanently secured, whereby the safety warning device is stationary.

17. A safety warning device comprising a primary and corresponding vertical post mounted to a base, whose base is not permanently secured allowing for portability a visual tape able to be secured between the primary and corresponding post a laser source secured to the primary post, wherein the laser source emits a focused laser beam a laser receiver for said laser source, secured to the corresponding post, which receives the laser beam thereby, completes the laser circuitry.

18. The safety warning device of claim 17 wherein the visual tape is a means for visually warning a person of impending danger.

19. The safety warning device of claim 17 further including an audible indication when an associated object interrupts said laser beam emitted by the laser source and received by the laser receiver.

20. The safety warning device of claim 17 wherein said base is permanently secured, whereby the safety warning device is stationary.

* * * * *